US007163278B2

(12) United States Patent
Lee et al.

(10) Patent No.: US 7,163,278 B2
(45) Date of Patent: Jan. 16, 2007

(54) INK-JET PRINTHEAD WITH IMPROVED INK EJECTION LINEARITY AND OPERATING FREQUENCY

(75) Inventors: Yong-soo Lee, Seoul (KR); Yong-soo Oh, Seongnam-si (KR); Keon Kuk, Yongin-si (KR); Ji-hyuk Lim, Suwon-si (KR); Dong-kee Sohn, Seoul (KR); Mun-cheol Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 219 days.

(21) Appl. No.: 10/864,390

(22) Filed: Jun. 10, 2004

(65) Prior Publication Data

US 2004/0263578 A1 Dec. 30, 2004

(30) Foreign Application Priority Data

Jun. 24, 2003 (KR) ..... 10-2003-0041059

(51) Int. Cl.
*B41J 2/05* (2006.01)

(52) U.S. Cl. ..... 347/56; 347/65

(58) Field of Classification Search ..... 347/20, 347/44, 47–48, 56, 61–65, 67
See application file for complete search history.

(56) References Cited

U.S. PATENT DOCUMENTS

| | | | | |
|---|---|---|---|---|
| 5,502,471 | A | 3/1996 | Obermeier et al. | 347/65 |
| 5,841,452 | A | 11/1998 | Silverbrook | 347/47 |
| 6,443,564 | B1 | 9/2002 | Keil et al. | 347/65 |
| 6,561,626 | B1 | 5/2003 | Min et al. | 347/47 |
| 6,595,627 | B1 * | 7/2003 | Min et al. | 347/65 |
| 6,886,919 | B1 * | 5/2005 | Lim et al. | 347/56 |
| 2002/0012024 | A1 | 1/2002 | Lee et al. | 347/47 |
| 2003/0081072 | A1 | 5/2003 | Trueba | 347/63 |
| 2003/0090548 | A1 | 5/2003 | Min et al. | 347/65 |

FOREIGN PATENT DOCUMENTS

| | | |
|---|---|---|
| EP | 1 215 048 A2 | 6/2002 |
| EP | 1 215 048 A3 | 6/2002 |
| JP | 60-204374 | 10/1985 |

* cited by examiner

*Primary Examiner*—Juanita D. Stephens
(74) *Attorney, Agent, or Firm*—Lee & Morse, P.C.

(57) ABSTRACT

An ink-jet printhead includes a substrate having an ink chamber and a manifold, a nozzle plate formed on the substrate, first and second heaters, first and second conductors, and first and second ink channels. The nozzle plate includes a plurality of passivation layers formed of an insulating material, a heat dissipation layer formed on the passivation layers and made of a thermally conductive material, and a nozzle passing through the nozzle plate and in flow communication with the ink chamber. The first and second heaters and conductors are interposed between adjacent passivation layers of the nozzle plate. The ink channels are interposed between the ink chamber and the manifold, for providing flow communication between the ink chamber and the manifold. The first and second heaters, conductors and ink channels are symmetric with respect to the nozzle.

13 Claims, 9 Drawing Sheets

INK-JET PRINTHEAD WITH IMPROVED INK EJECTION LINEARITY AND OPERATING FREQUENCY

BACKGROUND OF THE INVENTION

1. Field of the Invention

The present invention relates to an ink-jet printhead. More particularly, the present invention relates to a back-shooting type ink-jet printhead, in which two ink channels are provided symmetrically with respect to a nozzle, thereby improving a linearity of ejected ink droplets and increasing an operating frequency.

2. Description of the Related Art

In general, ink-jet printheads are devices for printing a predetermined image, color or black, by ejecting a small volume droplet of ink at a desired position on a recording sheet. Ink-jet printheads are generally categorized into two types depending on which ink ejection mechanism is used. A first type is a thermal ink-jet printhead, in which a heat source is employed to form and expand a bubble in ink to cause an ink droplet to be ejected due to the expansion force of the formed bubble. A second type is a piezoelectric ink-jet printhead, in which an ink droplet is ejected by a pressure applied to the ink due to a deformation of a piezoelectric element.

An ink droplet ejection mechanism of a thermal ink-jet printhead will now be explained in detail. When a pulse current is supplied to a heater, which includes a heating resistor, the heater generates heat and ink near the heater is instantaneously heated to approximately 300° C., thereby boiling the ink. The boiling of the ink causes bubbles to be generated, and exert pressure on ink filling an ink chamber. As a result, ink around a nozzle is ejected from the ink chamber in the form of a droplet through the nozzle.

A thermal ink-jet printhead is classified into a top-shooting type, a side-shooting type, and a back-shooting type depending on a bubble growing direction and a droplet ejection direction. In a top-shooting type of printhead, a bubble grows in the same direction in which an ink droplet is ejected. In a side-shooting type of printhead, a bubble grows in a direction perpendicular to a direction in which an ink droplet is ejected. In a back-shooting type of printhead, a bubble grows in a direction opposite to a direction in which an ink droplet is ejected.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after being ejected from the ink chamber should be as short as possible and the cooling of heated ink and heater should be performed quickly to increase a driving frequency.

FIG. 1 illustrates a partially exploded perspective view of a conventional top-shooting type ink-jet printhead. FIG. 2 illustrates a cross-sectional view of a vertical structure of the conventional ink-jet printhead of FIG. 1.

Referring to FIG. 1, the conventional ink-jet printhead includes a base plate 10, which is formed by stacking a plurality of material layers on a substrate, partition walls 20, which are stacked on the base plate 10 and define ink chambers 22, and a nozzle plate 30, which is stacked on the partition walls 20. Ink is contained in the ink chambers 22, and a heater 13, which is shown in FIG. 2, is disposed under the ink chambers 22 to heat the ink and generate bubbles. Ink paths 24 serve as paths through which the ink is supplied into the ink chambers 22 and provide flow communication from an ink container (not shown). A plurality of nozzles 32 is formed in the nozzle plate 30 at positions corresponding to the ink chambers 22 and allow the ink to be ejected therethrough.

The vertical structure of the ink-jet printhead will be explained with reference to FIG. 2. An insulation layer 12 is formed on a silicon substrate 11 to provide insulation between the heater 13 and the substrate 11. The heater 13 is formed on the insulation layer 12 to heat the ink filling the ink chambers 22 and generate bubbles. The heater 13 is formed by depositing a tantalum nitride layer or a tantalum-aluminum alloy layer on the insulation layer 12. A conductor 14 is disposed on the heater 13 to apply a current to the heater 13. The conductor 14 is made of a material having high conductivity, such as aluminum (Al) or an aluminum alloy.

A passivation layer 15 is formed on the heater 13 and the conductor 14 to protect the heater 13 and the conductor 14. The passivation layer 15 protects the heater 13 and the conductor 14 from being oxidized or directly contacting the ink, and is mainly formed by depositing a silicon nitride layer. Anti-cavitation layers 16 are formed on the passivation layer 15 at positions corresponding to the ink chambers 22.

The partition walls 20 are stacked on the base plate 10, which is formed by stacking the plurality of material layers, in order to define the ink chambers 22. The nozzle plate 30, in which the plurality of nozzles 32 is formed, is stacked on the partition walls 20.

In the ink-jet printhead constructed as above, the anti-cavitation layers 16 formed on the passivation layer 15 protect the heater 13 by preventing a cavitation pressure, which is generated when the bubbles burst, from being focused on a central portion of the heater 13. However, because of the anti-cavitation layers 16 formed on the passivation layer 15, the number of printhead manufacturing processes increases and it is difficult to transfer a sufficient amount of heat to the ink from the heater 15.

Recently, efforts have been made to increase the life span of the heater by making the ink paths asymmetric so that the cavitation pressure can be formed at regions other than the location of the heater or by distributing the cavitation pressure over a larger area so that the cavitation pressure can be decentralized.

FIG. 3 schematically illustrates a plan view of another conventional ink-jet printhead. Referring to FIG. 3, a heater 50 and a nozzle 52 are asymmetric with respect to a central portion of an ink chamber 54. An ink path 56 functions as a path through which ink is supplied into the ink chamber 54.

The conventional ink-jet printhead of FIG. 3 has advantages of changing the flow direction of the ink contained in the ink chamber 54 and reducing damage to the heater 50 caused when bubbles burst. However, the conventional ink-jet printhead in which the heater 50 and the nozzle 52 are asymmetric has disadvantages in that a linearity of ink droplets ejected through the nozzle 52 deteriorates, and a fluid that makes it difficult to refill the ink chamber 54 is generated, thereby decreasing an operating frequency of the printhead.

SUMMARY OF THE INVENTION

The present invention is therefore directed to an ink-jet printhead having an improved structure, which substantially overcomes one or more of the problems due to the limitations and disadvantages of the related art.

It is a feature of an embodiment of the present invention to provide an ink-jet printhead in which two ink channels are provided symmetrically with respect to a nozzle.

It is another feature of an embodiment of the present invention to provide an ink-jet printhead that is capable of improving a linearity of ejected ink droplets.

It is still another feature of an embodiment of the present invention to provide an ink-jet printhead that is capable of increasing an operating frequency.

At least one of the above features and other advantages may be provided by an ink-jet printhead including a substrate having an ink chamber to be filled with ink to be ejected formed in an upper portion thereof and a manifold for supplying ink to the ink chamber formed in a lower portion thereof, a nozzle plate formed on the substrate, the nozzle plate including a plurality of passivation layers formed of an insulating material, a heat dissipation layer formed on the plurality of passivation layers and made of a metallic material having good thermal conductivity, and a nozzle passing through the nozzle plate and in flow communication with the ink chamber, a first and a second heater and a first and a second conductor, which are interposed between adjacent layers of the plurality of passivation layers of the nozzle plate and symmetric with respect to the nozzle, the first and second heaters for heating ink filled in the ink chamber and the first and second conductors for applying a current to the first and second heaters, and a first and a second ink channel, which are interposed between the ink chamber and the manifold, for providing flow communication between the ink chamber and the manifold, the first and second ink channels being symmetric with respect to the nozzle.

The nozzle may be formed at a position corresponding to a central portion of the ink chamber, and the first and second ink channels may be formed at positions corresponding to the first and second heaters, respectively.

The first and second ink channels may be parallel to a top surface of the substrate. The first and second ink channels may be formed on a same plane with the ink chamber.

The substrate may be a silicon on insulator (SOI) substrate including a lower silicon substrate, an insulation layer, and an upper silicon substrate, which are sequentially stacked. The manifold may be formed in the lower silicon substrate, and the ink chamber and the ink channels may be formed in the upper silicon substrate.

The plurality of passivation layers may include a first, a second and a third passivation layer, which are sequentially stacked on the substrate, and the first and second heaters may be interposed between the first passivation layer and the second passivation layer, and the first and second conductors may be interposed between the second passivation layer and the third passivation layer.

A lower portion of the nozzle may be formed through the plurality of passivation layers, and an upper portion of the nozzle may be formed through the heat dissipation layer.

The upper portion of the nozzle formed through the heat dissipation layer may have a tapered shape such that a sectional area thereof decreases toward an outlet of the nozzle.

The heat dissipation layer may be formed of at least one metal material selected from the group consisting of nickel (Ni), copper (Cu), aluminum (Al), and gold (Au). The heat dissipation layer may be formed to a thickness between about 10 to 100 μm using an electroplating process.

A seed layer for electroplating the heat dissipation layer may be formed on the plurality of passivation layers. The seed layer may be made of at least one metal material selected from the group consisting of copper (Cu), chromium (Cr), titanium (Ti), gold (Au), and nickel (Ni).

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
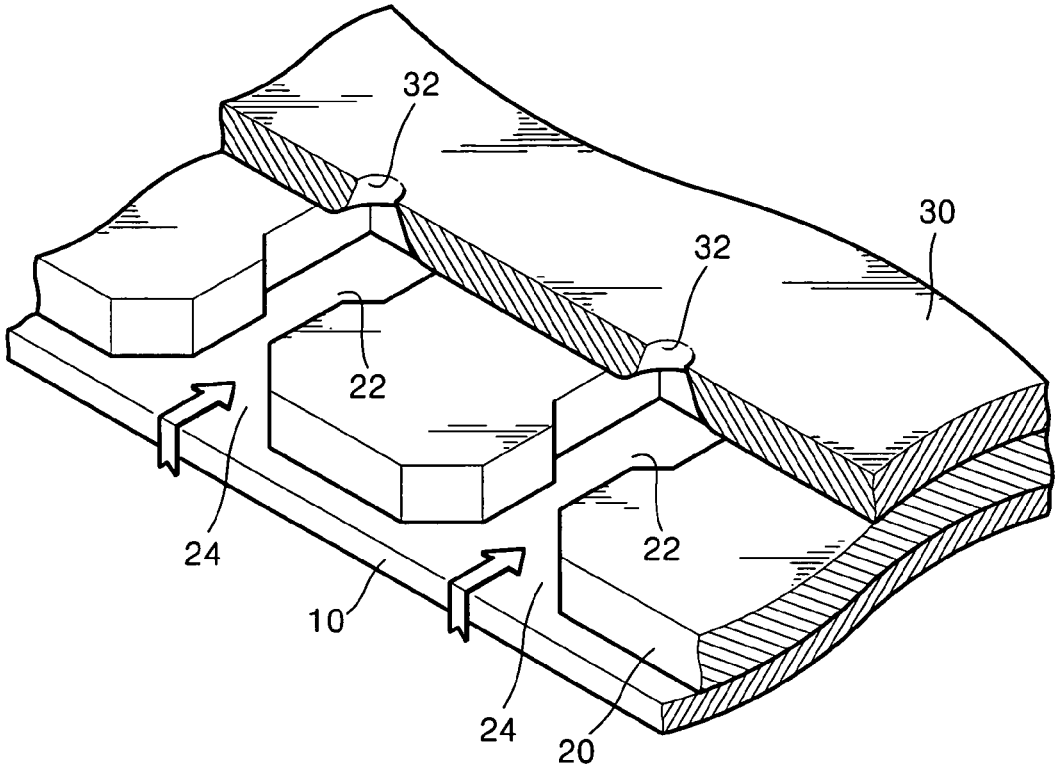
FIG. 1 (PRIOR ART)
FIG. 1 illustrates a partially exploded perspective view of a conventional ink-jet printhead.
Figure 2:
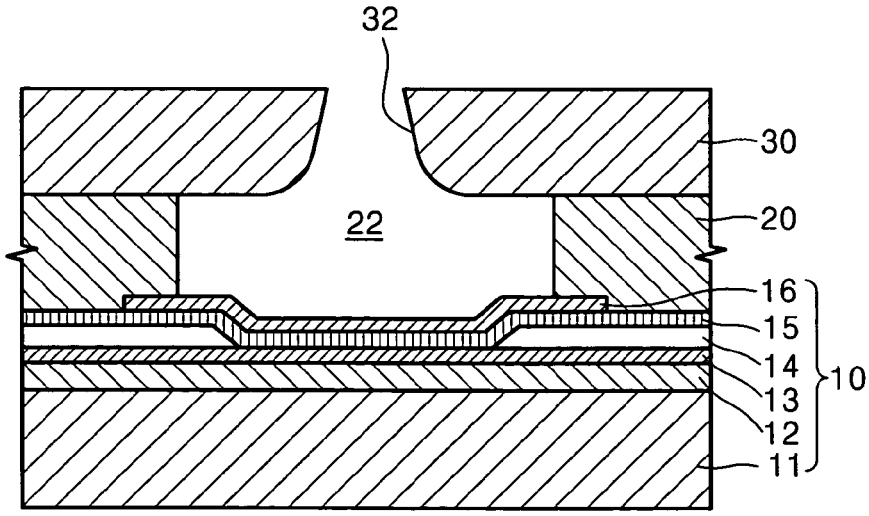
FIG. 2 (PRIOR ART)
FIG. 2 illustrates a cross-sectional view of a vertical structure of the ink-jet printhead of FIG. 1.
Figure 3:
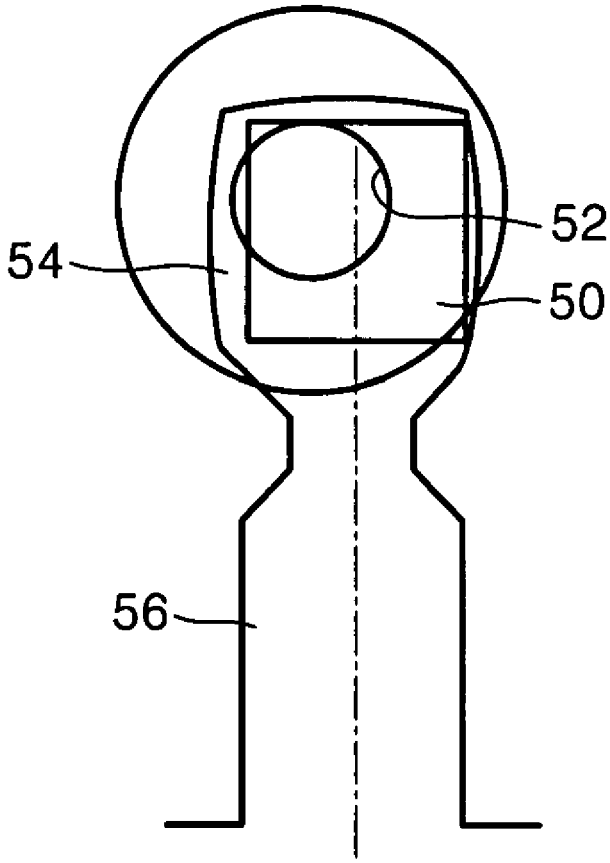
FIG. 3 (PRIOR ART)
FIG. 3 schematically illustrates a plan view of another conventional ink-jet printhead.

Korean Patent Application No. 2003-41059, filed on Jun. 24, 2003, in the Korean Intellectual Property Office, and entitled: "Ink-jet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 4:
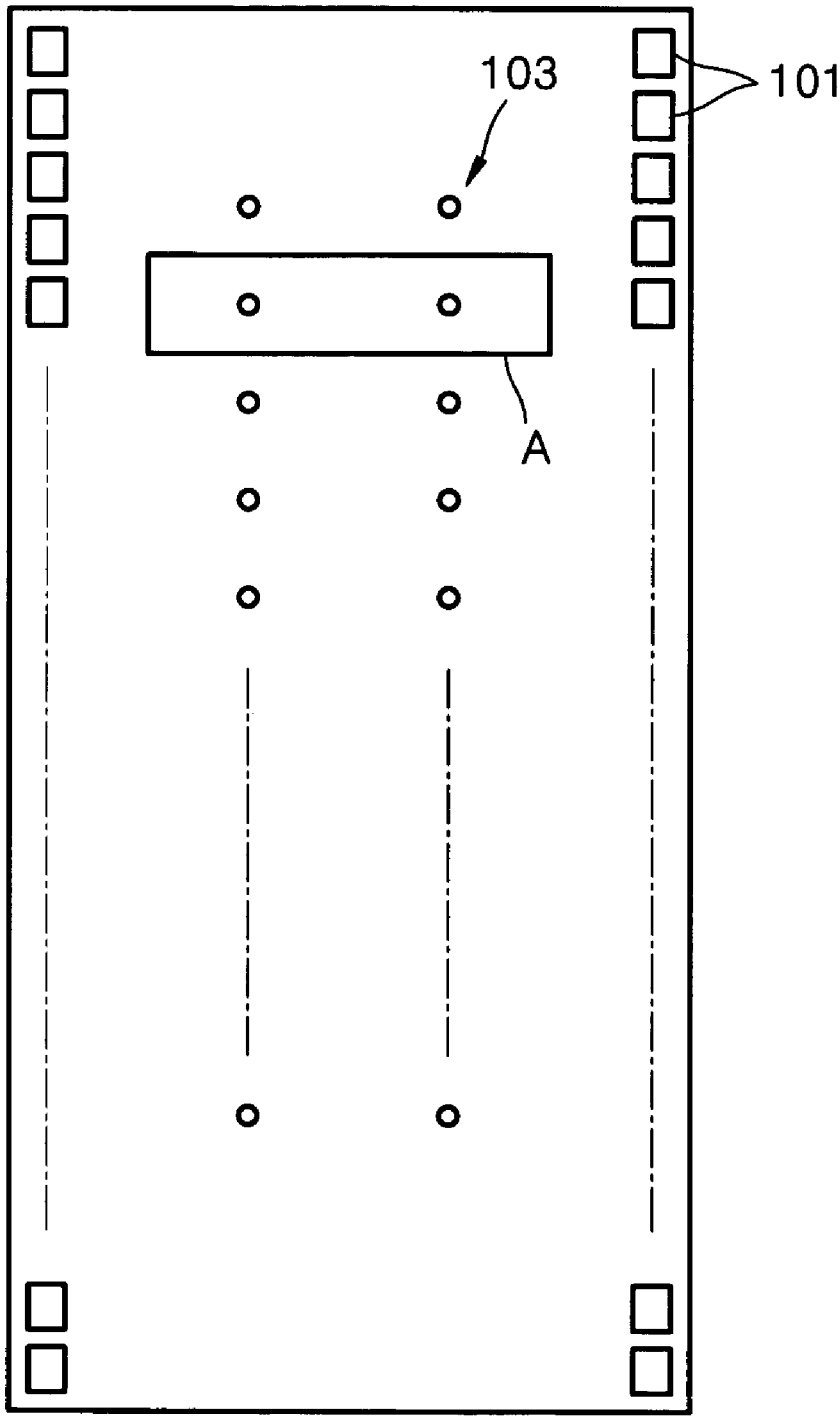
FIG. 4 illustrates a plan view of an ink-jet printhead according to an embodiment of the present invention.

FIG. 4 illustrates a plan view of an ink-jet printhead according to an embodiment of the present invention. Referring to FIG. 4, the ink-jet printhead includes ink ejection parts 103 exemplarily arranged in two rows and bonding pads 101, each of which is electrically connected to one of the ink ejection parts 103. While the ink ejection parts 103 are arranged in two rows in FIG. 4, in alternative embodiments, they can be arranged in a single row or they may be arranged in three or more rows to improve printing resolution.

Figure 5:
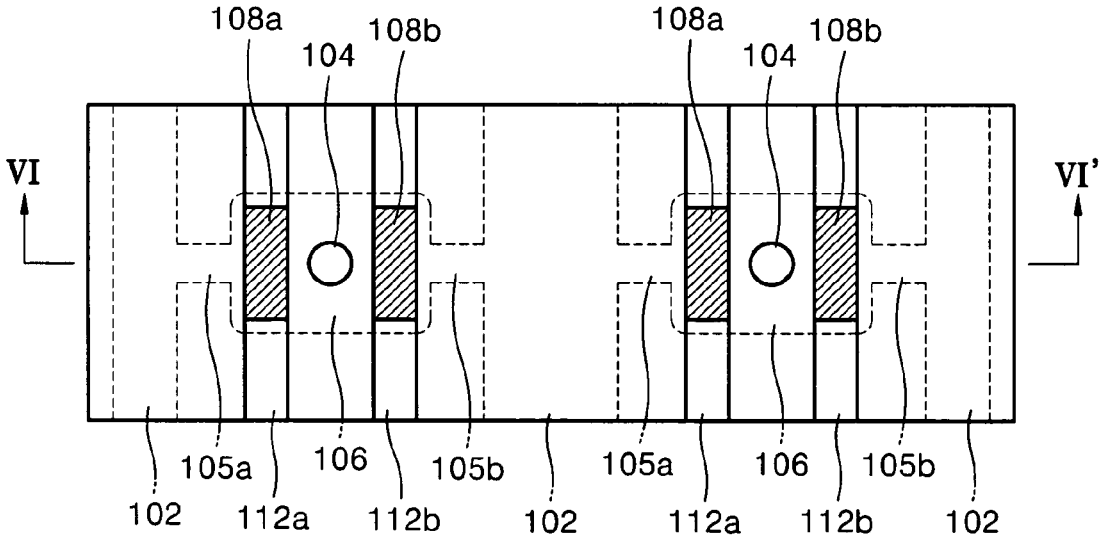
FIG. 5 illustrates an enlarged plan view of an area marked by a box "A" in FIG. 4.
Figure 6:
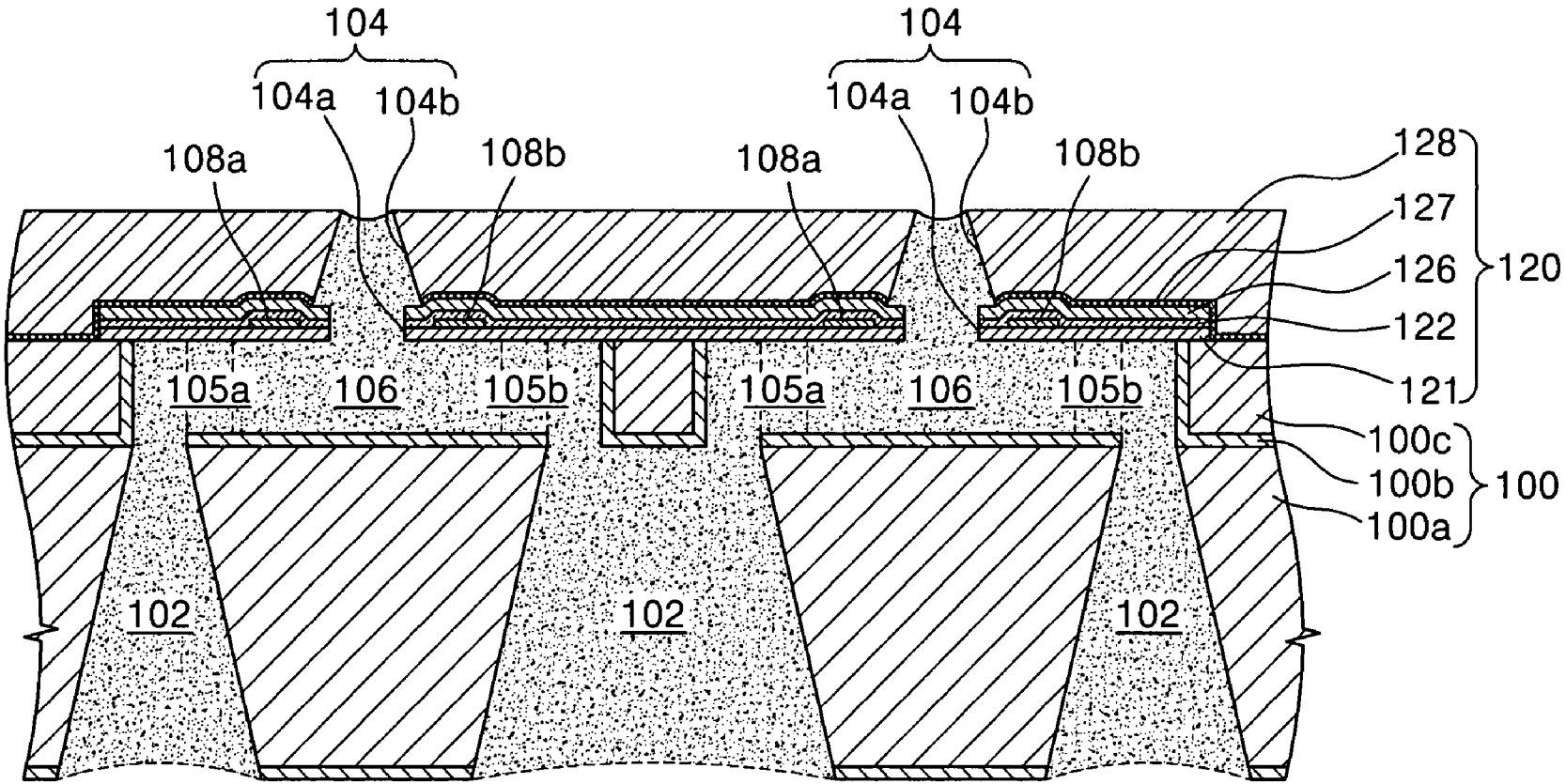
FIG. 6 illustrates a cross-sectional view of the ink-jet printhead, taken along the line VI–VI' of FIG. 5.

FIG. 5 illustrates an enlarged plan view of an area marked by a box "A" in FIG. 4. FIG. 6 illustrates a cross-sectional view of the ink-jet printhead, taken along the line VI–VI' of FIG. 5.

Referring to FIGS. 5 and 6, the ink-jet printhead according to an embodiment of the present invention includes a substrate 100 and a nozzle plate 120, which is stacked on the substrate 100.

An ink chamber 106 is formed in an upper portion of the substrate 100 and, in operation, ink to be ejected fills the ink chamber 106. A manifold 102 is formed in a lower portion of the substrate 100 and ink is supplied to the ink chamber 106 through the manifold 102. The ink chamber 106 and the manifold 102, which are formed by etching the upper portion and the lower portion of the substrate 100, respectively, may have various shapes. In addition, the manifold 102 is in flow communication with an ink container (not shown) in which ink is stored.

A first ink channel 105*a* and a second ink channel 105*b* are formed in the upper portion of the substrate 100 and interposed between the ink chamber 106 and the manifold 102 to provide flow communication between the ink chamber 106 and the manifold 102. The first and second ink channels 105*a* and 105*b* are formed in parallel to a top surface of the substrate 100, on a same-plane with the ink chamber 106, and pass through both sidewalls of the ink chamber 106. The first and second ink channels 105*a* and 105*b* are symmetric with respect to a nozzle 104 that is formed at a position corresponding to a central portion of the ink chamber 106. The first and second ink channels 105*a* and 105*b*, which are also formed by etching the upper portion of the substrate 100, similar to the ink chamber 106, may have various shapes.

According to an embodiment of the present invention, the substrate 100 may be a silicon on insulator (SOI) substrate, in which a lower silicon substrate 100*a*, an insulation layer 100*b*, and an upper silicon substrate 100*c* are sequentially stacked. In an SOI substrate, the ink chamber 106 and the first and second ink channels 105*a* and 105*b* are formed in the upper silicon substrate 100*c*, and the manifold 102 is formed in the lower silicon substrate 100*a*.

The nozzle plate 120 is stacked on the substrate 100, in which the ink chamber 106, the manifold 102, and the first and second ink channels 105*a* and 105*b* are formed. The nozzle plate 120 forms upper walls of the ink chamber 106 and the first and second ink channels 105*a* and 105*b*, and allows the nozzle 104 to vertically pass therethrough at a position corresponding to a central portion of the ink chamber 106.

The nozzle plate 120 includes a plurality of material layers stacked on the substrate 100. The plurality of material layers includes a first passivation layer 121, a second passivation layer 122, a third passivation layer 126, and a heat dissipation layer 128. A first heater 108*a* and a second heater 108*b* are interposed between the first passivation layer 121 and the second passivation layer 122, and a first conductor 112*a* and a second conductor 112*b* are interposed between the second passivation layer 122 and the third passivation layer 126. The first conductor 112*a* and the second conductor 112*b* are electrically connected to the first heater 108*a* and the second heater 108*b*, respectively.

The first passivation layer 121 is the lowest material layer of the plurality of material layers that constitute the nozzle plate 120, and is formed on the substrate 100. The first passivation layer 121 provides insulation between the first and second heaters 108*a* and 108*b* and the substrate 100 and protects the first and second heaters 108*a* and 108*b*. The first passivation layer 121 may be made of silicon oxide or silicon nitride.

The first and second heaters 108*a* and 108*b* are formed on the first passivation layer 121 at a position corresponding to the ink chamber 106 to heat the ink within the ink chamber 106. The first and second heaters 108*a* and 108*b* are symmetric with respect to the nozzle 104. The first heater 108*a* is disposed at a side of the first ink channel 105*a*, and the second heater 108*b* is disposed at a side of the second ink channel 105*b*.

The first and second heaters 108*a* and 108*b* may be formed of a same material and size so as to have the same resistance with respect to each other. The first and second heaters 108*a* and 108*b* may be heating resistors made of polysilicon doped with impurities, tantalum nitride, titanium nitride, or tungsten silicide. The first and second heaters 108*a* and 108*b* may be formed by depositing the heating resistors on the first passivation layer 121 to a predetermined thickness and then patterning the deposited heating resistors. More specifically, a heating resistor of polysilicon doped with a source gas, e.g., phosphorous (P), may be deposited, e.g., using low-pressure chemical vapor deposition (LPCVD), to a predetermined thickness ranging from approximately 0.7 to 1 μm. A heating resistor of tantalum-aluminium alloy, tantalum nitride, titanium nitride, or tungsten suicide may be deposited, e.g., using sputtering or chemical vapor deposition (CVD), to a predetermined thickness ranging from approximately 0.1 to 0.3 μm. The thickness of the heating resistor may be determined in accordance with the width and length of the first and second heaters 108*a* and 108*b* in order to provide an appropriate resistance.

Subsequently, the heating resistors deposited on the entire surface of the passivation layer 121 are patterned, e.g., by a photolithography process using a photo mask and a photoresist and by an etching process using a photoresist pattern as an etching mask. The first and second heaters 108*a* and 108*b* may have shapes other than the rectangular shapes shown in FIG. 5.

In operation, since the first and second heaters 108*a* and 108*b* are respectively disposed at positions that correspond to the first and second ink channels and are symmetric with respect to the nozzle 104, bubbles generated by the two heaters 108*a* and 108*b* grow and burst in a same cycle and have a same size. Further, a meniscus symmetrically recedes after an ink droplet is ejected. The ejected ink droplet correctly arrives at a desired position on a recording sheet. Additionally, since ink does not stagnate in the ink chamber 106 after ink is ejected, surfaces of the heaters 108*a* and 108*b* are rapidly cooled.

The second passivation layer 122 is formed on the first passivation layer 121 and the first and second heaters 108*a* and 108*b*. The second passivation layer 122 is interposed and provides insulation between the first and second heaters 108*a* and 108*b* and the first and second conductors 112*a* and 112*b*. The second passivation layer 122 is made of silicon oxide or silicon nitride, similarly to the first passivation layer 121.

The first and second conductors 112*a* and 112*b* are disposed on the second passivation layer 122, and are electrically connected to the first and second heaters 108*a* and 108*b*, respectively, to apply a pulse current to the first and second heaters 108*a* and 108*b*. The first and second conductors 112*a* and 112*b* each have a first end connected to the first and second heaters 108*a* and 108*b*, respectively, through contact holes (not shown) formed in the second passivation layer 122, and a second end electrically connected to the bonding pads 101 shown in FIG. 4. The first and second conductors 112*a* and 112*b* may be made of a metal material having high conductivity, such as aluminium (Al), an aluminium alloy, gold (Au), or silver (Ag).

The third passivation layer 126 is formed on the first and second conductors 112*a* and 112*b* and the second passivation layer 122. The third passivation layer 126 may be made of tetraethylorthosilicate (TEOS) oxide, silicon oxide, or silicon nitride.

The heat dissipation layer 128 is formed on the third passivation layer 126, and part of the heat dissipation layer 128 is in contact with the top surface of the substrate 100. The heat dissipation layer 128 is preferably made of at least one metal material. The metal material is a material having high thermal conductivity, such as, nickel (Ni), copper (Cu), aluminium (Al), or gold (Au). The heat dissipation layer 128 may be formed by electroplating the metal material on the third passivation layer 126 and the substrate 100 to have a relatively large thickness ranging from about 10 to 100 μm. A seed layer 127 may be formed on the third passivation layer 126 and the substrate 100 to be used in electroplating the metal material. The seed layer 127 may be made of at least one metal material having high electrical conductivity, such as copper (Cu), chromium (Cr), titanium (Ti), gold (Au) or nickel (Ni).

As previously mentioned, since the heat dissipation layer 128 made of the metal material is formed through an electroplating process, the heat dissipation layer 128 can be integrally formed with other elements of the ink-jet printhead. Moreover, since the heat dissipation layer 128 has a relatively large thickness, effective heat dissipation can be ensured.

As mentioned above, the heat dissipation layer 128 is in partial contact with the top surface of the substrate 100 and transfers heat, which is generated by and remains around the first and second heaters 108*a* and 108*b*, to the substrate 100. More specifically, after ink is ejected, heat from the first and second heaters 108*a* and 108*b* and heat remaining around the first and second heaters 108*a* and 108*b* are transferred to the substrate 100 and then dissipated out of the printhead through the heat dissipation layer 128. Thus, rapid heat dissipation is accomplished and the temperature around the nozzle 104 rapidly decreases after the ink is ejected, thereby resulting in a stable printing process at a high operating frequency.

Further, since the heat dissipation layer 128 has a relatively large thickness, the nozzle 104 can be made sufficiently long. Consequently, stable high-speed printing can be performed, and the linearity of the ink droplets ejected through the nozzle 104 can be enhanced. That is, the ink droplets can be ejected exactly perpendicular to the top surface of the substrate 100.

The nozzle 104, which includes a lower nozzle 104*a* and an upper nozzle 104*b*, passes through the nozzle plate 120 at the position corresponding to the central portion of the ink chamber 106. The lower nozzle 104*a* has a cylindrical shape passing through the first, second, and third passivation layers 121, 122, and 126 of the nozzle plate 120. The upper nozzle 104*b* passes through the heat dissipation layer 128. The upper nozzle 104*b* may have a cylindrical shape but, more preferably, may have a tapered shape having a sectional area that decreases toward an outlet of the nozzle 104. If the upper nozzle 104*b* is formed in the tapered shape, a motion of a meniscus formed on a surface of ink can be stabilized more rapidly after an ink droplet is ejected.

An ink ejection mechanism of the ink-jet printhead according to an embodiment of the present invention will now be explained below with reference to FIGS. 7A through 7D.

Figure 7A:
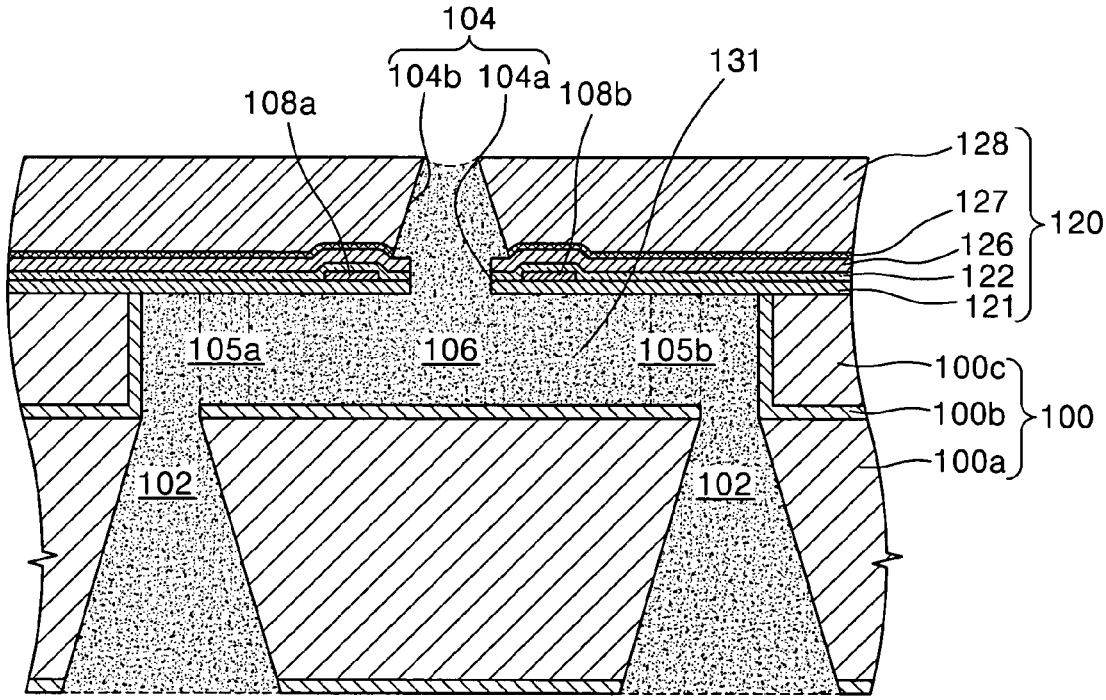
FIGS. 7A through 7D illustrate cross-sectional views for explaining an ink ejection mechanism in the ink-jet printhead according to an embodiment of the present invention.
Figure 7B:
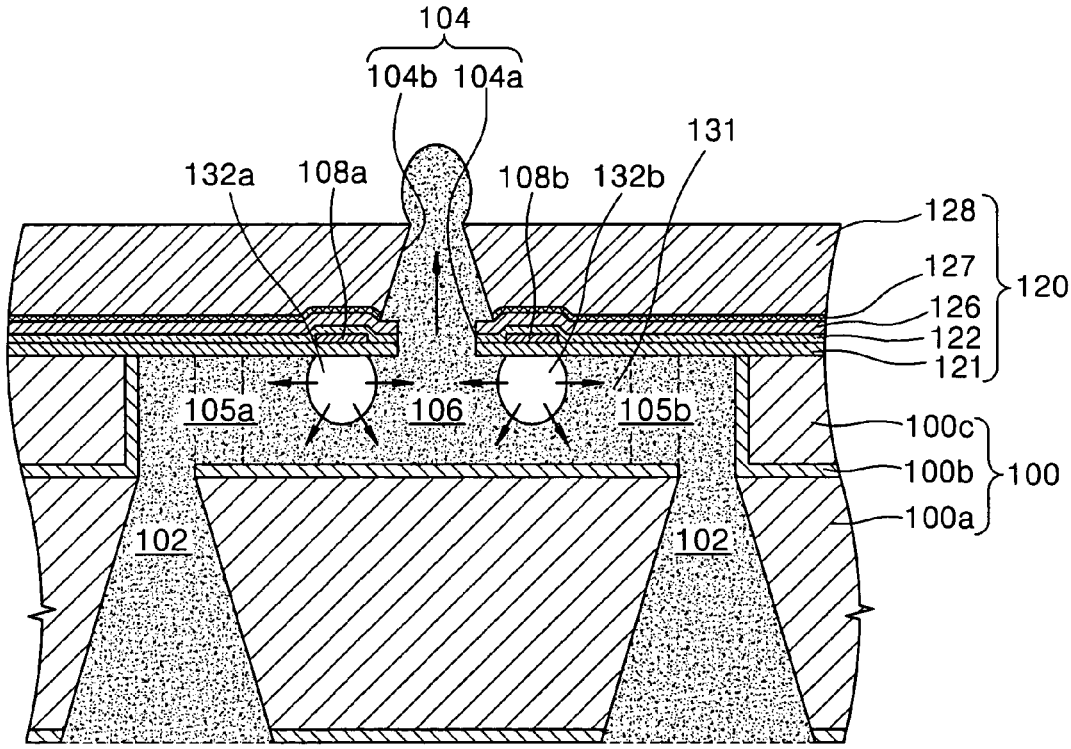

Referring to FIG. 7A, in a state where ink 131 fills the ink chamber 106 and the nozzle 104, if a pulse current is applied to the first and second heaters 108*a* and 108*b* via the conductors 112*a* and 112*b* shown in FIG. 5, heat is generated by the first and second heaters 108*a* and 108*b*. The generated heat is transferred to the ink 131 in the ink chamber 106 through the first passivation layer 121. Accordingly, as shown in FIG. 7B, the ink 131 in the ink chamber 106 boils to form first and second bubbles 132*a* and 132*b*. Then, the generated bubbles 132*a* and 132*b* expand due to a continuous heat supply, and thus ink 131 in the nozzle 104 is pushed out of the nozzle 104. Since the first and second ink channels 105*a* and 105*b* respectively corresponding to the first and second heaters 108*a* and 108*b* are symmetric with respect to the nozzle 104, the first and second bubbles 132*a* and 132*b* that are generated by the first and second heaters 108*a* and 108*b*, respectively, are created at the same time and have the same size.

Figure 7C:
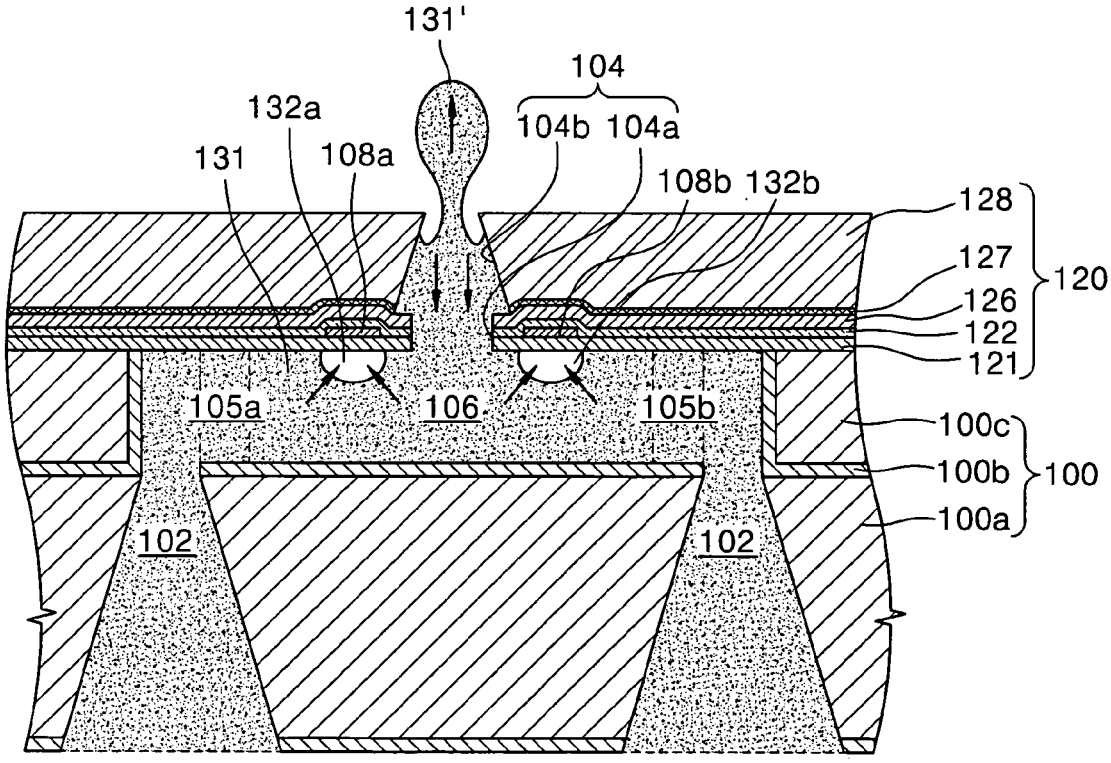

Referring to FIG. 7C, when the applied current is cut off in the state where the first and second bubbles 132*a* and 132*b* are maximally expanded, the first and second bubbles 132*a* and 132*b* start to contract and finally burst. At this time, a negative pressure is formed inside the ink chamber 106, and the ink 131 in the nozzle 104 flows back into the ink chamber 106. At the same time, a portion of the ink pushed out of the nozzle 104 is separated from the ink 131 in the nozzle 104 and ejected in the form of an ink droplet 131'.

After the ink droplet 131' is ejected, the meniscus formed on the surface of the ink 131 in the nozzle 104 recedes toward the ink chamber 106. Because the nozzle 104 has a sufficient length due to the relatively thick nozzle plate 120, the meniscus recedes into the nozzle 104 but cannot recede into the ink chamber 106. Accordingly, outside air is prevented from entering the ink chamber 106, and the meniscus quickly returns to an initial state thereof so that stable ejection of the ink droplet 131' occurs at high speed. Furthermore, since the heat generated by and remaining around the first and second heaters 108*a* and 108*b* is dissipated to the substrate 100 or out of the printhead through the heat dissipation layer 128 after ejection of the ink droplet 131', the temperature of and around the first and second heaters 108*a* and 108*b* and the nozzle 104 decreases rapidly.

In addition, because the first and second ink channels 105*a* and 105*b* are symmetric with respect to the nozzle 104, the first and second bubbles 132*a* and 132*b* contract and burst at the same time, and the meniscus on the surface of the ink 131 symmetrically recedes after ejection of the ink droplet 131'. The ejected ink droplet 131' correctly arrives at a desired position on a recording sheet.

Figure 7D:
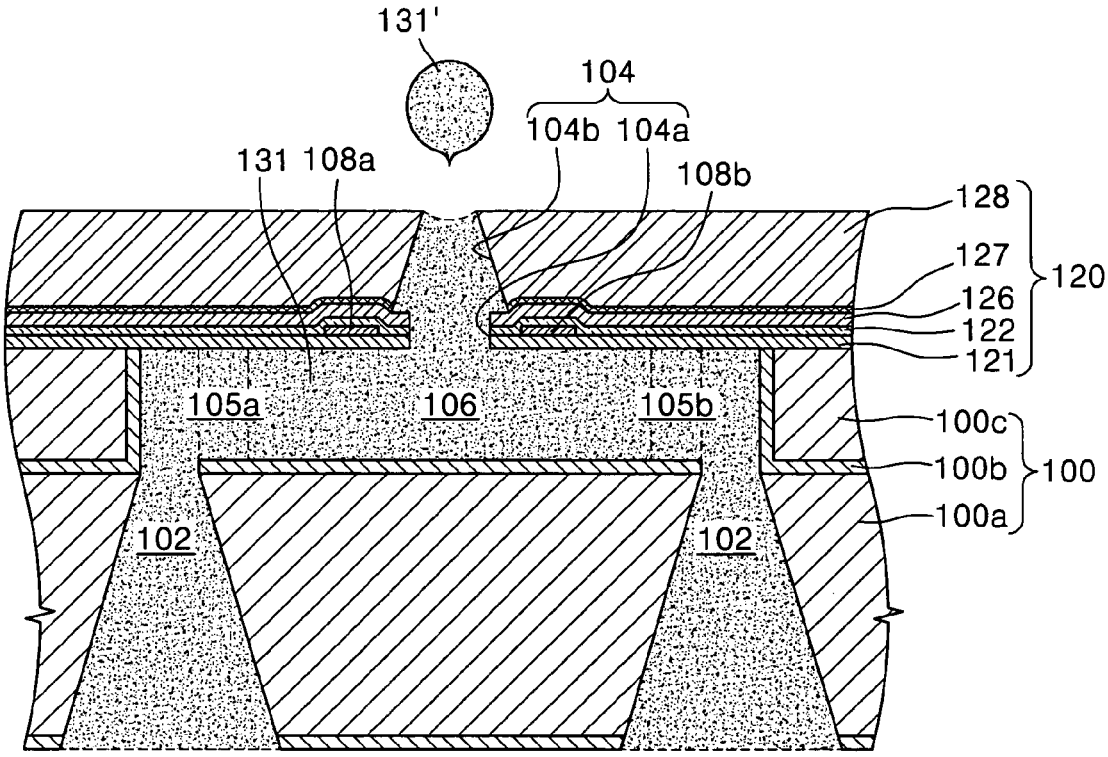

Referring to FIG. 7D, when the negative pressure formed inside the ink chamber 106 is removed, the ink 131 again rises toward the outlet of the nozzle 104 due to surface tension applied to the meniscus formed inside the nozzle 104. Advantageously, if the upper nozzle 104*b* has a tapered shape, the speed at which the ink 131 rises is increased. Accordingly, the ink chamber 106 is replenished with new ink supplied through the first and second ink channels 105*a* and 105*b*. Here, since the first and second ink channels 105*a* and 105*b* are symmetric with respect to the nozzle 104, ink 131 does not stagnate inside the ink chamber 106. As a result, the surfaces of the first and second heaters 108*a* and

108*b* are rapidly cooled. Then, when the ink 131 is completely refilled and the printhead returns to the initial state, the above-described processes are repeated.

As described above, in the ink-jet printhead according to the present invention, since the two ink channels are symmetric with respect to the nozzle, bubbles generated by the two heaters grow and burst in the same cycle and have the same size. The ejected ink droplet correctly arrives at a desired position on a recording sheet, and the meniscus formed on the surface of the ink symmetrically recedes after ejection of the ink droplet. Because ink does not stagnate inside the ink chamber after ejection of the ink droplet, the surfaces of the first and second heaters are rapidly cooled. Accordingly, the operating frequency of the printhead is improved.

Exemplary embodiments of the present invention have been disclosed herein and, although specific terms are employed, they are used and are to be interpreted in a generic and descriptive sense only and not for purpose of limitation. For example, each element of the ink-jet printhead may be made of a material other than those mentioned, and the specific figures suggested in each step are variable within a range where the manufactured ink-jet printhead can normally operate. Accordingly, it will be understood by those of ordinary skill in the art that various changes in form and details may be made without departing from the spirit and scope of the present invention as set forth in the following claims.

What is claimed is:

1. An ink-jet printhead, comprising:

a substrate having an ink chamber to be filled with ink to be ejected formed in an upper portion thereof and a manifold for supplying ink to the ink chamber formed in a lower portion thereof;

a nozzle plate formed on the substrate, the nozzle plate including a plurality of passivation layers formed of an insulating material, a heat dissipation layer formed on the plurality of passivation layers and made of a metallic material having good thermal conductivity, and a nozzle passing through the nozzle plate and in flow communication with the ink chamber;

a first and a second heater and a first and a second conductor, which are interposed between adjacent layers of the plurality of passivation layers of the nozzle plate and symmetric with respect to the nozzle, the first and second heaters for heating ink filled in the ink chamber and the first and second conductors for applying a current to the first and second heaters; and a first and a second ink channel, which are interposed between the ink chamber and the manifold, for providing flow communication between the ink chamber and the manifold, the first and second ink channels being symmetric with respect to the nozzle.

2. The ink-jet printhead as claimed in claim 1, wherein the nozzle is formed at a position corresponding to a central portion of the ink chamber, and the first and second ink channels are formed at positions corresponding to the first and second heaters, respectively.

3. The ink-jet printhead as claimed in claim 1, wherein the first and second ink channels are parallel to a top surface of the substrate.

4. The ink-jet printhead as claimed in claim 3, wherein the first and second ink channels are formed on a same plane with the ink chamber.

5. The ink-jet printhead as claimed in claim 1, wherein the substrate is a silicon on insulator (SOI) substrate including a lower silicon substrate, an insulation layer, and an upper silicon substrate, which are sequentially stacked.

6. The ink-jet printhead as claimed in claim 5, wherein the manifold is formed in the lower silicon substrate, and the ink chamber and the first and second ink channels are formed in the upper silicon substrate.

7. The ink-jet printhead as claimed in claim 1, wherein the plurality of passivation layers comprises a first, a second and a third passivation layer, which are sequentially stacked on the substrate, and wherein the first and second heaters are interposed between the first passivation layer and the second passivation layer, and the first and second conductors are interposed between the second passivation layer and the third passivation layer.

8. The ink-jet printhead as claimed in claim 1, wherein a lower portion of the nozzle is formed through the plurality of passivation layers, and an upper portion of the nozzle is formed through the heat dissipation layer.

9. The ink-jet printhead as claimed in claim 8, wherein the upper portion of the nozzle formed through the heat dissipation layer has a tapered shape such that a sectional area thereof decreases toward an outlet of the nozzle.

10. The ink-jet printhead as claimed in claim 1, wherein the heat dissipation layer is formed of at least one metal material selected from the group consisting of nickel (Ni), copper (Cu), aluminum (Al), and gold (Au).

11. The ink-jet printhead as claimed in claim 1, wherein the heat dissipation layer is formed to a thickness between about 10 to 100 μm using an electroplating process.

12. The ink-jet printhead as claimed in claim 1, wherein a seed layer for electroplating the heat dissipation layer is formed on the plurality of passivation layers.

13. The ink-jet printhead as claimed in claim 12, wherein the seed layer is made of at least one metal material selected from the group consisting of copper (Cu), chromium (Cr), titanium (Ti), gold (Au), and nickel (Ni).

* * * * *